US007732385B2

(12) United States Patent
Yagishita

(10) Patent No.: US 7,732,385 B2
(45) Date of Patent: Jun. 8, 2010

(54) LUBRICATING OIL ADDITIVES, LUBRICATING OIL COMPOSITIONS CONTAINING SUCH ADDITIVES AND PROCESSES FOR PRODUCING SUCH ADDITIVES AND COMPOSITIONS

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 672 days.

(21) Appl. No.: 11/020,087

(22) Filed: Dec. 22, 2004

(65) Prior Publication Data

US 2005/0113265 A1 May 26, 2005

Related U.S. Application Data

(63) Continuation of application No. PCT/JP03/008337, filed on Jun. 30, 2003.

(30) Foreign Application Priority Data

Jun. 28, 2002 (JP) ..... 2002-191089

(51) Int. Cl.
*C10M 137/06* (2006.01)
*C10M 159/12* (2006.01)

(52) U.S. Cl. ..... 508/188; 508/227; 508/228; 508/371; 508/375; 508/420

(58) Field of Classification Search ..... 508/420, 508/436, 188, 442, 227, 228, 368, 369, 370, 508/371, 375

See application file for complete search history.

(56) References Cited

U.S. PATENT DOCUMENTS

| | | | | | |
|---|---|---|---|---|---|
| 3,813,336 | A * | 5/1974 | Goldschmidt | ..... | 508/420 |
| 4,306,984 | A * | 12/1981 | Yamaguchi | ..... | 508/228 |
| 4,483,775 | A * | 11/1984 | Yamaguchi | ..... | 508/228 |
| 4,487,704 | A * | 12/1984 | Yamaguchi et al. | ..... | 508/228 |
| 4,965,002 | A * | 10/1990 | Brannen et al. | ..... | 508/188 |
| 5,439,606 | A * | 8/1995 | Papay | ..... | 508/188 |
| 5,719,109 | A * | 2/1998 | Tokashiki et al. | ..... | 508/364 |
| 5,763,370 | A * | 6/1998 | Doner et al. | ..... | 508/364 |
| 5,811,377 | A * | 9/1998 | Watts et al. | ..... | 508/188 |
| 5,972,851 | A * | 10/1999 | Srinivasan et al. | ..... | 508/188 |
| 6,300,292 | B2 * | 10/2001 | Konishi et al. | ..... | 508/371 |
| 6,352,962 | B1 * | 3/2002 | Hata et al. | ..... | 508/188 |
| 6,482,778 | B2 * | 11/2002 | Tersigni et al. | ..... | 508/188 |
| 6,525,004 | B1 * | 2/2003 | Hartley et al. | ..... | 508/188 |
| 6,613,722 | B1 * | 9/2003 | Watts et al. | ..... | 508/195 |
| 6,617,287 | B2 * | 9/2003 | Gahagan et al. | ..... | 508/192 |
| 6,656,887 | B2 * | 12/2003 | Yagishita et al. | ..... | 508/371 |
| 6,730,640 | B2 * | 5/2004 | Sowerby et al. | ..... | 508/371 |
| 6,764,982 | B2 * | 7/2004 | Bardasz et al. | ..... | 508/293 |
| 6,777,378 | B2 * | 8/2004 | Abraham et al. | ..... | 508/185 |
| 6,797,678 | B2 * | 9/2004 | Hata et al. | ..... | 508/188 |
| 6,797,679 | B2 * | 9/2004 | Kawasaki et al. | ..... | 508/272 |

FOREIGN PATENT DOCUMENTS

| | | | |
|---|---|---|---|
| EP | 0 325 977 | A1 | 8/1989 |
| GB | 1 237 581 | A | 6/1971 |
| JP | 42-12646 | A | 7/1942 |
| JP | 63-099082 | B2 | 4/1988 |
| JP | 03-020395 | A | 1/1991 |
| JP | 03-258897 | A | 11/1991 |
| JP | 05-065493 | A | 3/1993 |
| JP | 05-222068 | A | 8/1993 |
| JP | 08-245656 | A | 9/1996 |
| JP | 10-147788 | A | 6/1998 |
| JP | 11-323363 | A | 11/1999 |
| JP | 2002-155291 | A | 5/2002 |
| JP | 2002-294271 | A | 10/2002 |
| JP | 2004-083751 | A | 3/2004 |

* cited by examiner

*Primary Examiner*—Ellen M McAvoy
(74) *Attorney, Agent, or Firm*—Panitch Schwarze Belisario & Nadel LLP

(57) ABSTRACT

Disclosed are lubricating oil additives obtained by dissolving or reacting (A) a metal salt of a specific phosphorus compound which is insoluble or less soluble in lubricating oils in or with (B) an amine compound so as to be solved in the lubricating oils; a lubricating oil composition containing such an additive; a method of producing the additive and composition.

14 Claims, No Drawings

LUBRICATING OIL ADDITIVES, LUBRICATING OIL COMPOSITIONS CONTAINING SUCH ADDITIVES AND PROCESSES FOR PRODUCING SUCH ADDITIVES AND COMPOSITIONS

CROSS-REFERENCE TO RELATED APPLICATION

This application is a continuation of International Application No. PCT/JP03/008337, filed Jun. 30, 2003, which was published in the Japanese language on Jan. 8, 2004, under International Publication No. WO 2004/003118 A1, the disclosure of which is incorporated herein by reference.

FILED OF THE INVENTION

The present invention relates to lubricating oil additives and more specifically to those which are obtained by making metal salts of phosphorus compounds insoluble or less soluble in lubricating base oils, soluble therein, lubricating oil compositions containing such additives, and a process for producing the additives and compositions.

BACKGROUND OF THE INVENTION

Long drain oils have been desired than before from the viewpoints of recent demands such as effective use of resources, decrease of waste oils, and reduction of costs incurred by the users.

The inventors of the present invention found that in order to enhance the long drain properties of a lubricating oil, a low sulfur-content lubricating oil composition containing a metal salt of a monothiophosphate ester-based compound reduced in sulfur in the molecules or that of a phosphate ester-based compound or phosphonate ester each containing no sulfur in the molecules instead of a sulfur-containing anti-wear and -oxidation agent such as zinc dialkyldithiophosphate, had excellent base number retaining properties and oxidation stability leading to long drain properties while maintaining anti-wear properties and was capable of exhibiting high temperature detergency and low friction properties. The inventors had already filed patent applications of these inventions which were assigned to Japanese Patent Application Nos. 2002-015351 and 2002-246975, respectively.

While zinc dialkyldithiophosphates are liquid at ordinary temperature, these metal salts of phosphorus compounds are solid at ordinary temperature and thus have problems that they are not only poor in handling properties but also low in dissolubility in the lubricating oil or require a long period of time to be dissolved as they are. Therefore, the problems make it difficult to mass-produce a lubricating oil composition containing these metal salts of the phosphorus compounds industrially efficiently.

In view of the foregoing situations, the present invention is intended to provide a technique for liquefying metal salts of phosphorus compounds with low dissolubility in a lubricating oil so as to be dissolved therein efficiently for a short period of time, thereby producing industrially efficiently a lubricating oil composition containing a metal salt of a specific phosphorus compound, with excellent properties such as long drain properties.

DISCLOSURE OF THE INVENTION

As a result of an extensive study conducted for solving the above-described problems, the present invention was achieved based on the finding that phosphorus compounds as described above were able to be improved in dissolubility in a lubricating oil by dissolving or reacting the compounds in and with an amine compound beforehand.

That is, the object of the present invention is to provide a lubricating oil additive produced by dissolving or reacting (A) at least one type of compound selected from the group consisting of metal salts of phosphorus compounds represented by formulas (1), (2) and (3) below in or with (B) an amine compound:

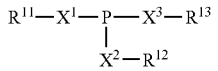

(1)

wherein $X^1$, $X^2$, and $X^3$ are each independently oxygen or sulfur provided that at least one of them is oxygen and $R^{11}$, $R^{12}$, and $R^{13}$ are each independently hydrogen or a hydrocarbon group having 1 to 30 carbon atoms provided that at least one of them is hydrogen;

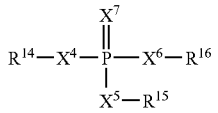

(2)

wherein $X^4$, $X^5$, $X^6$, and $X^7$ are each independently oxygen or sulfur provided that at least three of them are oxygen and $R^{14}$, $R^{15}$, and $R^{16}$ are each independently hydrogen or a hydrocarbon group having 1 to 30 carbon atoms provided that at least one of them is hydrogen; and

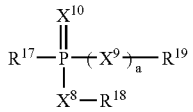

(3)

wherein $X^8$, $X^9$, and $X^{10}$ are each independently oxygen or sulfur provided that at least two of them are oxygen, $R^{17}$, $R^{18}$, and $R^{19}$ are each independently hydrogen or a hydrocarbon group having 1 to 30 carbon atoms provided that at least one of them is hydrogen, and a is an integer of 0 or 1; and the phosphorus compounds of formulas (1) to (3) may contain a group represented by —(OR') n-wherein R' is an alkylene group having 1 to 4 carbon atoms and n is an integer of 1 to 10, between any X—R bonds.

In the lubricating oil additives of the present invention, all $X^1$, $X^2$ and $X^3$ of formula (1), $X^4$, $X^5$, $X^6$ and $X^7$ of formula (2), and $X^8$, $X^9$ and $X^{10}$ of formula (3) are preferably oxygen.

A metal of Component (A) is preferably at least one type of metal selected from the group consisting of lithium, magnesium, calcium, and zinc.

Component (B) is at least one type of amine compound selected from the group consisting of amine-based anti-oxidants, aliphatic amines, and ashless dispersants and derivatives thereof.

One of the lubricating oil additives of the present invention is that produced by dissolving Component (A) in an amine-based anti-oxidant.

One of the lubricating oil additives of the present invention is that produced by reacting Component (A) or the foregoing lubricating oil additive with an aliphatic amine.

One of the lubricating oil additives of the present invention is that produced by reacting Component (A) or any of the foregoing lubricating oil additives with an ashless dispersant and/or a derivative thereof.

In the foregoing lubricating oil additive, the reaction ratio of the aliphatic amine or the ashless dispersant or derivative thereof to Component (A) is preferably 0.15 or more by mass.

The ashless dispersant and derivative thereof are those having a base number of 5 mgKOH/g or more determined by a hydrochloric acid method.

The derivative of the ashless dispersant is preferably a boron compound derivative of the ashless dispersant.

The lubricating oil additive of the present invention is that obtained by blending any of the foregoing lubricating additives with at least one type of additive selected from the group consisting of lubricating base oils, anti-oxidants, ashless dispersants, metallic detergents, friction modifiers, anti-wear agents, corrosion inhibitors, rust inhibitors, demulsifiers, metal passivators, anti-foaming agents, dyes, and viscosity index improvers.

The present invention also provides a lubricating oil composition produced by blending any of the foregoing lubricating oil additives with a lubricating base oil.

Furthermore, the present invention provides a process for producing a lubricating oil additive by dissolving or reacting (A) at least one type of compound selected from the group consisting of metal salts of phosphorus compounds represented by formula (1), (2) and (3) in or with (B) an amine compound.

The present invention also provides a process for producing a lubricating oil composition by blending the foregoing lubricating additive with a lubricating oil.

The present invention will be described in more details below.

Examples of Component (A) include salts obtained by allowing a phosphorus compound represented by formula (1), (2) or (3) below to react with a metal base selected from metal oxides, metal hydroxides, metal carbonates and metal chlorides so as to neutralize a part or whole of the remaining acid hydrogen:

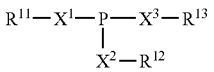

(1)

wherein $X^1$, $X^2$, and $X^3$ are each independently oxygen or sulfur provided that at least one of them is oxygen and $R^{11}$, $R^{12}$, and $R^{13}$ are each independently hydrogen or a hydrocarbon group having 1 to 30 carbon atoms provided that at least one of them is hydrogen;

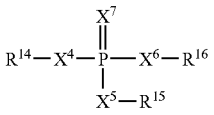

(2)

wherein $X^4$, $X^5$, $X^6$, and $X^7$ are each independently oxygen or sulfur provided that at least three of them are oxygen and $R^{14}$, $R^{15}$, and $R^{16}$ are each independently hydrogen or a hydrocarbon group having 1 to 30 carbon atoms provided that at least one of them is hydrogen; and

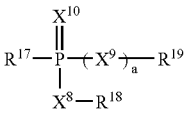

(3)

wherein $X^8$, $X^9$, and $X^{10}$ are each independently oxygen or sulfur provided that at least two of them are oxygen, $R^{17}$, $R^{18}$, and $R^{19}$ are each independently hydrogen or a hydrocarbon group having 1 to 30 carbon atoms provided that at least one of them is hydrogen, and a is an integer from 0 or 1.

The phosphorus compounds of formulas (1) to (3) may or may not contain between X—R bonds a group represented by $—(OR')_n—$ wherein R' is an alkylene group having 1 to 4, preferably 1 or 2 carbon atoms and n is an integer of 1 to 10, preferably 1 to 4. Preferably, the compounds have no —(OR')n- group between X—R bonds with the objective of enhanced anti-wear properties and extreme pressure properties.

Specific examples of metals of the above-described metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkali metals such as lithium and sodium, alkaline earth metals such as magnesium and calcium, and zinc, and most preferred is zinc.

The above-described metal salts of the phosphorus compounds vary in structure depending on the valence of metals and the number of OH or SH group of the phosphorus compounds. Therefore, no particular limitation is imposed on the structure of the metal salts of the phosphoric compounds. For example, when 1 mol of zinc oxide is reacted with 2 mol of a phosphoric acid diester (with one OH group), it is assumed that a compound with a structure represented by the formula below is obtained as the main component but polymerized molecules may also exist:

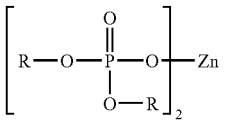

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

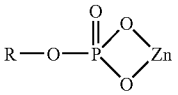

Specific examples of hydrocarbon groups having 1 to 30 carbon atoms for $R^{11}$ to $R^{19}$ include alkyl, cycloalkyl, alkenyl, alkyl-substituted cycloalkyl, aryl, alkyl-substituted aryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups. Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl group include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, and octadecenyl groups, all of which may be straight-chain or branched and the position of which the double bonds may vary.

Examples of the aryl group include phenyl and naphtyl groups. Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Hydrocarbon groups having 1 to 30 carbon atoms for $R^{11}$ to $R^{19}$ are preferably alkyl groups having 1 to 30 carbon atoms and aryl groups having 6 to 24 carbon atoms, more preferably alkyl groups having 3 to 18 carbon atoms, further more preferably alkyl groups having 4 to 10 carbon atoms, and particularly preferably alkyl groups having 4 to 6 carbon atoms with the objective of enhanced anti-wear properties and extreme pressure properties.

Examples of phosphorus compounds of formula (1) include phosphorus acid, monothiophosphorus acid and dithiophosphorus acid; phosphorus acid monoesters, monothiophosphorus acid monoesters and dithiophosphorus acid monoesters, each having one of the above described hydrocarbons having 1 to 30 carbon atoms; phosphorus acid diesters, monothiophosphorus acid diesters and dithiophosphorus acid diesters, each having two of the above-described hydrocarbons having 1 to 30 carbon atoms; and mixtures thereof.

In the present invention, preferably two or more of $X^1$, $X^2$ and $X^3$ in formula (1) are oxygen, and more preferably all of $X^1$, $X^2$ and $X^3$ are oxygen.

Examples of phosphorus compounds of formula (2) include phosphoric acid and monothiophosphoric acid; phosphoric acid monoesters and monothiophosphoric acid monoesters, each having one of the above-described hydrocarbons having 1 to 30 carbon atoms; phosphoric acid diesters and monothiophosphoric acid diesters, each having two of the above-described hydrocarbons having 1 to 30 carbon atoms; and mixtures thereof.

In the present invention, preferably all of $X^4$ to $X^7$ in formula (2) are oxygen.

Examples of phosphorus compounds of formula (3) include phosphonic acid and monothiophosphonic acid, each having one of the above-described hydrocarbons having 1 to 30 carbon atoms; phosphonic acid monoesters and monothiophophonic acid monoesters, each having two of the above-described hydrocarbons having 1 to 30 carbon atoms; and mixtures thereof.

In the present invention, preferably all of $X^8$ to $X^{10}$ in formula (3) are oxygen.

Component (A) is preferably selected from salts of phosphorus acid diesters having two alkyl or aryl groups having 3 to 18 carbon atoms and a zinc-, molybdenum-, calcium-, magnesium- or lithium base; those of phosphoric acid diesters having two alkyl or aryl groups having 3 to 18 carbon atoms and a zinc-, molybdenum-, calcium-, magnesium- or lithium base; and those of alkyl- or aryl-phosphonic acid monoesters having two alkyl or aryl groups having 3 to 18 carbon atoms and a zinc-, molybdenum-, calcium-, magnesium- or lithium base.

One or more types of Components (A) may be arbitrarily blended.

No particular limitation is imposed on the method of producing the metal salts of the phosphorus compounds used in the present invention since they may be produced by any conventional method. For the zinc salt of a phosphoric acid diester, it is obtained by a method wherein 2 mol of a phosphoric compound of formula (2) is mixed with 0.1 to 2 mol, preferably 0.5 to 1 mol and particularly preferably 0.8 to 0.98 mol of a zinc base such as zinc oxide, zinc hydroxide, zinc carbonate and zinc chloride, 0.2 to 2 L, preferably 0.5 to 1.5 L of an organic solvent, and 0.05 to 1 L, preferably 0.1 to 0.5 L of water and reacted by heating at a temperature of 40 to 100° C., preferably 60 to 90° C. for 0.5 to 10 hours, preferably 1 to 6 hours. After the water phase is removed and the organic solvent is filtered out, the solvent is vacuum-distilled. The zinc salt of a phosphoric acid monoester is obtained by the same manner as described above using 2 mol of a phosphorus compound of formula (2) and 0.2 to 4 mol, preferably 1 to 2 mol, and particularly preferably 1.6 to 1.96 mol of a zinc base such as zinc oxide, zinc hydroxide, zinc carbonate and zinc chloride. No particular limitation is imposed on the organic solvent. Examples of the organic solvent include those generally known such as alcohols, hexane, benzene, toluene, xylene and decalin as well as compounds having an aromatic ring and lubricating base oils.

In the present invention, the neutralization rate of a metal salt of a phosphorus compound is preferably 50 percent or higher, more preferably 80 percent or higher, and particularly preferably 90 percent or higher. Compounds obtained by such a manner, such as zinc di(2-ethylhexyl)phosphate, zinc di(2-ethylhexyl)monothiophosphate, calcium di(2-ethylhexyl) phosphate, zincdibutylphosphate, and zinc 1,3-dimethylbutylphosphate are white solid and low in dissolubility in a lubricating base oil, additives exclusive of Component (B), or a lubricating oil composition containing no Component (B) as they are. Therefore, even though any of the above compounds in a state wherein it is dissolved in the organic solvent is dissolved in such a base oil, additives or a composition, it may precipitate upon distillation of the organic solvent. Furthermore, even though any of these compounds is heated and mixed with a lubricating oil composition containing Component (B) or a lubricating base oil, Component (B) and other additives exclusive thereof simultaneously, it takes a long time for the compound to be dissolved completely. Therefore, the undissolved metal salt of the phosphorus compound must be filtered if necessary, resulting in inefficient industrial production of the intended additive or lubricating oil composition.

Examples of other methods for producing Component (A) include a method of Dorinson (ASLE Trans., 22(2), 190

(1967)), that of Handley (Analyt. Chem., 35, pp 991-995 (1963)), and those disclosed in Japanese Patent Publication Nos. 42-12646 and 5-29357 and Japanese Laid-Open Patent Publication Nos. 5-222068 and 8-245656. Component (A) obtained in a solid state is preferably mixed with or dissolved in an organic solvent before being mixed with Component (B). Component (A) obtained without distilling out the organic solvent in the above-exemplified methods can be mixed with Component (B). Alternatively, any of the above-described materials for Component (A) may be mixed first and then reacted with Component (B) or any of the materials thereof.

Component (B) of the present invention is an amine compound. Examples of such an amine compound include various amine compounds. Preferred examples of Component (B) include amine-based anti-oxidants, aliphatic amines, and ashless dispersants and/or derivatives thereof.

Examples of (B-1) amine-based anti-oxidants include various aromatic amine compounds, and preferred examples include those generally known to be used for lubricating oils, such as alkyldiphenylamines, alkylnaphtylamines, phenyl-α-naphtylamines, and alkylphenyl-α-naphtylamines. These amine-based anti-oxidants are preferably those which are liquid at ordinary temperature. The use of these amine-based anti-oxidants are preferable because of their extremely high dissolubility of Component (A). The alkyl groups of the above anti-oxidants are those having 1 to 30, preferably 3 to 20, and particularly preferably 4 to 10 carbon atoms, the substitution number of which alkyl groups is 1 to 4, preferably 1 or 2.

The ashless dispersant is preferably at least one type of compound selected from (B-2) succinimides, (B-3) benzylamines, (B-4) polyamines and Mannich reaction products of polyamines with alkyl- or alkenyl-phenols and formaldehyde, and derivatives of these compounds.

The above-described ashless dispersants and/or derivative thereof have a base number (as measured by hydrochloric acid method) of preferably 5 mgKOH/g or higher, more preferably 10 mgKOH/g or higher, and particularly preferably 20 mgKOH/g or higher. The base number measured by hydrochloric acid method means a value measured by a potentiometric titration method in accordance with section 6 of JIS K2501.

Specific examples of (B-2) succinimides include compounds represented by the following formulas:

(4)

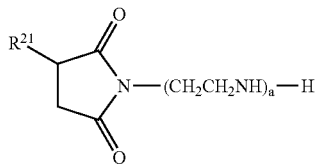

(5)

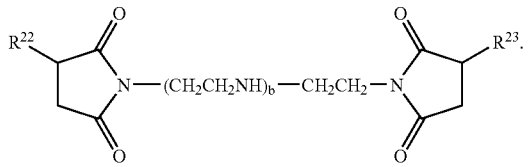

In formula (4), $R^{21}$ is an alkyl or alkenyl group having 12 to 400, preferably 60 to 200, and particularly preferably 70 to 150 carbon atoms, and a is an integer from 1 to 5, preferably 2 to 4.

In formula (5), $R^{22}$ and $R^{23}$ are each independently an alkyl or alkenyl group having 12 to 400, preferably 60 to 200, and particularly preferably 70 to 150 carbon atoms and particularly preferably a polybutenyl group, and b is an integer from 0 to 4, preferably 1 to 3.

Succinimides are classified into mono-type succinimides wherein a succinic anhydride is added to one end of a polyamine by imidization as represented by formula (4) and bis-type succinimides wherein a succinic anhydride is added to both ends of a polyamine by imidization as represented by formula (5). In the present invention, both types of the succinimides and mixtures thereof can be used as Component (B-2).

No particular limitation is imposed on methods of producing the above-described succinimides. For example, a method is used wherein a polybutenyl succinimide obtained by reacting a chlorinated polybutene or polyisobuten (5 to 100 percent by mol of which has at the terminal ends a vinylidene structure) or a polybutene from which chlorine and fluorine have been sufficiently removed, with maleic anhydride at a temperature of 100 to 200° C. is reacted with a polyamine such as diethylene triamine, triethylene tetramine, tetraethylene pentamine or pentaethylene hexamine. In the case of producing a bissuccinimide, a polybutenyl succinimide as obtained above in an amount (molar ratio) of twice as much as polyamine may be reacted therewith, while in the case of producing a monosuccinimide, such a polybutenyl succinimide in the same amount (molar ratio) may be reacted therewith. Among these succinimides, polybutenyl bissuccinimides are preferable because they can impart oxidation stability and sludge dispersibility to the resulting lubricating composition.

Specific examples of (B-3) benzylamines include compounds represented by the following formula:

(6)

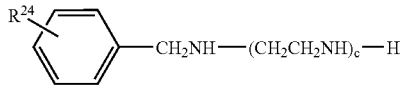

In formula (6), $R^{24}$ is an alkyl or alkenyl group having 12 to 400, preferably 60 to 200, and particularly preferably 70 to 150 carbon atoms, and c is an integer from 1 to 5, preferably 2 to 4.

The benzylamines may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (B-4) polyamines include compounds represented by the following formula:

$$R^{25}—NH—(CH_2CH_2NH)_d—H \quad (7)$$

In formula (7), $R^{25}$ is an alkyl or alkenyl group having 12 to 400, preferably 60 to 200, and particularly preferably 70 to 150 carbon atoms, and d is an integer from 1 to 5, preferably 2 to 4.

The polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, or pentaethylenehexamine.

Specific examples of derivatives of the ashless dispersants include various modified compounds obtained by allowing any of the nitrogen-containing compounds (B-2) to (B-4) to react with a boron compound, an oxygen-containing organic compound, a sulfur compound, or a combination of two or more of these compounds so as to neutralize or amidize the whole or part of the remaining amino groups and/or imino groups.

Examples of the boron compound include boric acids, borates, and boric acid esters. Specific examples of boric acids include orthoboric acid, methaboric acid, and tetraboric acid. Examples of borates include alkali metal salts, alkaline earth metal salts, or ammonium salts, of boric acid. Specific examples of borates include lithium borates such as lithium methaborate, lithium tetraborate, lithium pentaborate, and lithium perborate; sodium borates such as sodium methaborate, sodium diborate, sodium tetraborate, sodium pentaborate, sodium hexaborate, and sodium octaborate; potassium borates such as potassium methaborate, potassium tetraborate, potassium pentaborate, potassium hexaborate, and potassium octaborate; calcium borates such as calcium methaborate, calcium diborate, tricalcium tetraborate, pentacalcium tetraborate, and calcium hexaborate; magnesium borates such as magnesium methaborate, magnesium diborate, trimagnesium tetraborate, pentamagnesium tetraborate, and magnesium hexaborate; and ammonium borates such as ammonium methaborate, ammonium tetraborate, ammonium pentaborate, and ammonium octaborate.

Examples of boric acid esters include esters of boric acid and an aliphatic alcohol preferably having 1 to 6 carbon atoms. Specific examples of boric acid esters include monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

Derivatives obtained by reacting a succinimide with any of the above-described boron compounds are preferably used because they can impart heat resistance and oxidation stability to the resulting lubricating oil composition. No particular limitation is imposed on the ratio of the equivalent weight of nitrogen to that of boron (B/N equivalent weight ratio). However, the B/N equivalent weight ratio is preferably 1 or less, more preferably 0.7 or less, and particularly preferably 0.5 or less because the derivatives are prone to form a complex with Component (A).

Specific examples of the oxygen-containing organic compound include monocarboxylic acids having 1 to 30 carbon atoms, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid, and eicosanoic acid; polycarboxylic acid having 2 to 30 carbon atoms, such as oxalic acid, phthalic acid, trimellitic acid, pyromellitic acid, and anhydrides thereof and ester compounds thereof; alkyleneoxides having 2 to 6 carbon atoms; and hydroxy(poly)oxyalkylene carbonates. By allowing such oxygen-containing organic compounds to react as described above, the whole or part of the amino or imino groups in a compound of any of formula (4) to (7) assumedly has a structure as represented by the following formula

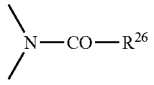

(8)

In formula (8), $R^{26}$ is hydrogen, an alkyl, alkenyl or alkoxy group having 1 to 24 carbon atoms, or a hydroxy(poly)oxyalkylene group represented by $—O—(R^{27}O)_m H$ wherein $R^{27}$ is an alkylene group having 1 to 4 carbon atoms, and m is an integer from 1 to 5.

Components (B-2) to (B-4) and derivatives thereof are particularly preferably used because it is assumed that these components form a complex by reacting with Component (A) and thus can be present stably in a lubricating oil additive or a lubricating oil composition thereby shortening the time for producing a lubricating oil composition. Among Components (B-2) to (B-4) and derivatives thereof, preferred are (B-2) succinimides and/or derivatives thereof and derivatives obtained by modifying Component (B-2) to (B-4) with a boron compound, and particularly preferred are derivatives obtained by modifying Component (B-2) with a boron compound because they can enhance the heat resistance, oxidation stability and extreme pressure properties of the lubricating oil additive or lubricating oil composition of the present invention.

Examples of other amine compounds used as Component (B) include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, propylbutylamine, pentylmethylamine, hexylmethylamine, heptylmethylamine, octylmethylamine, nonylmethylamine, decylmethylamine, undecylmethylamine, dodecylmethylamine, tridecylmethylamine, tetradecylmethylamine, pentadecylmethylamine, hexadecylmethylamine, heptadecylmethylamine, octadecylmethylamine, trimethylamine, ethyldimethylamine, propyldimethylamine, butyldimethylamine, hexyldimethylamine, octyldimethylamine, decyldimethylamine, dodecyldimethylamine, and octadecyldimethylamine; alkenylamines having a straight-chain or branched alkenyl group having 2 to 30 carbon atoms, such as ethenylamine, propenylamine, butenylamine, octenylamine, oleylamine, octenylmethylamine, decenylmethylamine, dodecenylmethylamine, octadecenylmethylamine, octenyldimethylamine, decenyldimethylamine, dodecenyldimethylamine, and octadecenyldimethylamine; alicyclic amines having a cycloalkyl, alkyl or alkenylcycloalkyl group having 3 to 30 carbon atoms (these alkyl and alkenyl groups may be straight-chain or branched and locate at any position) such as cyclohexylamine, methylcyclohexylamine, and ethylcyclohexylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, decanolamine, dodecanolamine, octadecanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these amine compounds, preferred examples include aliphatic amines having an alkyl or alkenyl group having 8 to 20, preferably 12 to 18 carbon atoms, which amines may be straight-chain or branched, such as decylamine, dodecylamine, tridecylamine, heptadecylamine, octadecylamine, oleylamine, stearylamine, decyldimethylamine, undecyldiethylamine, undecyldiethanolamine, dodecyldimethylamine, tridecyldimethylamine, heptadecyldimethylamine, octadecyldimethylamine, oleyldimethylamine, and stearyldimethylamine.

The use of aliphatic amines, preferably aliphatic monoamines as Component (B) can produce a lubricating oil additive further having an excellent friction reducing effect between metal parts. Among Components (B), aliphatic tertiary amines are particularly preferable because a lubricating oil additive with more excellent extreme pressure properties can be produced.

In the present invention, one or a mixture of two or more of the above-described amine compounds may be used as Component (B).

Examples of preferred embodiments of the present invention include the following:

(1) a lubricating oil additive comprising a mixture of Component (A) and an amine-based anti-oxidant;

(2) a lubricating oil additive obtained by reacting Component (A) or the lubricating oil additive of (1) above and an ashless dispersant and/or a derivative thereof;

(3) a lubricating oil additive obtained by reacting Component (A) or the lubricating oil additive of (1) above and an aliphatic amine;

(4) a lubricating oil additive obtained by reacting Component (A) and a mixture of an amine-based anti-oxidant and an ashless dispersant and/or a derivative thereof; and (5) a lubricating oil additive obtained by reacting Component (A) and a mixture of an amine-based anti-oxidant and an aliphatic amine.

It is assumed that in the lubricating oil additive (1) above, Component (A) is in a state in which it is dissolved in the amine-based anti-oxidant and that in the lubricating oil additives (2) to (5) above, Component (A) is liquefied by forming a complex with an aliphatic amine or an ashless dispersant and/or a derivative thereof.

Preferred lubricating oil additives for the present invention include those of (2) to (5), and more preferred additives include those of (2) and (4).

No particular limitation is imposed on the process of producing the lubricating oil additive of the present invention as long as Component (A) is dissolved in or reacted with Component (B). Preferably, Component (A) in a state in which it is mixed with or dissolved in the above-described organic solvent beforehand is mixed with Component (B) and then stirred, the organic solvent being distilled if necessary. No particular limitation is imposed on the conditions for mixing and stirring. Mixing and stirring are conducted at a temperature of preferably 15 to 150° C., more preferably 30 to 120° C., and particularly preferably 40 to 90° C. Mixing and stirring are preferably conducted at a boiling point or lower of the selected organic solvent in view of safety. Time for mixing and stirring is preferably from 5 minutes to 5 hours, more preferably from 20 minutes to 3 hours, and particularly preferably from 30 minutes to 1 hour. Distillation of the organic solvent is conducted by a method such as vacuum distillation and continued until the solvent is distilled. The lubricating additive of the present invention thus obtained usually contains Component (A) in an amount of 0.5 to 20 percent by mass, preferably 1 to 10 percent by mass, in terms of phosphorus, based on the total mass of the additive.

No particular limitation is imposed on the mixing ratio of Components (A) to (B) upon preparation of the lubricating oil additive of the present invention. Component (A) and Component (B) are mixed at a ratio of 1 part by mass: 0.1 to 30 part by mass, preferably 1 part by mass: 0.15 part by mass or more, more preferably 1 part by mass: 0.2 part by mass or more, further more preferably 1 part by mass: 0.3 part by mass or more, even more preferably 1 part by mass: 0.5 part by mass or more, and particularly preferably 1 part by mass: 0.8 part by mass or more and preferably 1 part by mass: 10 part by mass or less and more preferably 1 part by mass: 5 part by mass or less. If 1 part by mass of Component (A) is reacted with 0.15 part by mass or more of Component (B), particularly an aliphatic amine or an ashless dispersant and/or a derivative thereof, the resulting lubricating oil additive is easily dissolved in a lubricating base oil even though it is added thereto alone.

The lubricating oil additive of the present invention is a basic additive which has long drain properties as defined by base number retaining properties and oxidation stability while maintaining the anti-wear properties of a lubricating oil composition and is advantageously used for imparting thereto enhanced high temperature detergency and low friction properties. However, in order to further enhance the performance characteristics of the resulting lubricating oil composition, the lubricating oil additive may be blended with at least one type of additive selected from the group consisting of anti-oxidants, ashless dispersants, metallic detergents, friction modifiers, anti-wear agents, corrosion inhibitors, rust inhibitors, demulsifiers, metal passivators, anti-foaming agents, dyes, and viscosity index improvers. If necessary, a small amount of a lubricating base oil may be added so as to adjust the viscosity of the lubricating oil additive of the present invention. In this case, the lubricating oil additive of the present invention may be provided in the form of an additive package in which it is blended with any of the above-mentioned various additives depending on the requisite properties of the resulting lubricating oil composition. A process for producing a lubricating oil composition can be simplified by blending such an additive package with a lubricating base oil thereby producing a cost-advantageous lubricating oil composition. The lubricating oil composition of the present invention may be produced by adding the lubricating oil additive of the present invention or an additive package in which the additive of the present invention is blended with various additives, to a lubricating base oil (or if necessary a lubricating oil composition containing other various additives) and mixing and stirring them at a temperature of 15 to 150° C., preferably 40 to 120° C., and particularly preferably 60 to 90° C.

No particular limitation is imposed on the amount of the lubricating oil additive of the present invention added to a lubricating base oil or a lubricating oil composition. The lower limit amount is preferably 0.005 percent by mass, more preferably 0.01 percent by mass, and particularly preferably 0.02 percent by mass and the upper limit amount is preferably 0.4 percent by mass, more preferably 0.2 percent by mass, and particularly preferably 0.1 percent by mass in terms of phosphorus based on the total mass of the composition.

Described next will be lubricating base oils constituting the lubricating oil composition of the present invention and the above-mentioned additives other than the lubricating oil additive of the present invention, to be added if necessary.

No particular limitation is imposed on lubricating base oils used in the present invention. Therefore, conventional mineral and synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax).

Although no particular limitation is imposed on the total aromatic content of mineral base oils, it is preferably 15 percent by mass or less, more preferably 10 percent by mass or less, further more preferably 5 percent by mass or less, and particularly preferably 2 percent by mass or less. A base oil of a total aromatic content exceeding 15 percent by mass is not preferably because the oxidation stability of the resulting lubricating oil composition would be poor.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics such as pyridines, quinolines, phenols, and naphthols.

Although no particular limitation is imposed on the sulfur content of mineral base oils, it is preferably 0.01 percent by mass or less, more preferably 0.005 percent by mass or less, and particularly preferably 0.001 percent by mass or less. A lubricating oil composition with excellent long drain properties can be obtained by decreasing the sulfur content of a mineral base oil.

Specific examples of synthetic lubricating oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyol esters such as trimethylolpropane caprylate, trimethylolpropane pelargonate, pentaerythritol-2-ethyl hexanoate, and pentaerythritol pelargonate; triesters such as neopentyl glycol; aromatic synthetic oils such as alkylnaphthalenes, alkylbenzenes, and aromatic esters; and mixtures thereof.

Any one of the above-described mineral base oils or synthetic base oils or a mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular limitation is imposed on the kinematic viscosity at 100° C. of the lubricating base oil used in the present invention, it is preferably 20 $mm^2/s$ or lower, more preferably 10 $mm^2/s$ or lower and preferably 1 $mm^2/s$ or higher, more preferably 2 $mm^2/s$ or higher. A lubricating base oil with a kinematic viscosity at 100° C. exceeding 20 $mm^2/s$ is not preferable because the low temperature viscosity characteristics of the resulting lubricating oil composition would be deteriorated, while that with a kinematic viscosity at 100° C. of less than 1 $mm^2/s$ is not also preferable because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferable because the resulting lubricating oil composition would be large in evaporation loss of the base oil and sulfur compounds, phosphorus compounds or metals in the composition would accumulate on an exhaust gas purifying device together with the base oil if the composition is used as an internal combustion engine lubricating oil and thus would adversely affect the exhaust gas purifying performance. The term "NOACK evaporation" used herein is defined as the amount of a sample lubricating oil of 60 g, which is lost when the oil is retained at a temperature of 250° C. and a pressure of 20 $mmH_2O$ (196 Pa) for one hour in accordance with ASTM D 5800.

Although no particular limitation is imposed on the viscosity index of the lubricating base oil used, it is preferably 80 or higher, more preferably 100 or higher, and further more preferably 120 or higher so as to be able to obtain excellent viscosity characteristics from low temperatures to high temperatures. A lubricating base oil with a viscosity index of less than 80 is not preferable because the low temperature viscosity characteristics of the resulting lubricating oil composition would be deteriorated.

Examples of anti-oxidants include those which have been used in lubricating oils, such as phenol- or metal-based anti-oxidants, other than amine-based anti-oxidants exemplified as Component (B). Addition of any of the anti-oxidants can further enhance the long drain properties of the resulting lubricating oil composition.

Examples of phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate, and 3-methyl-5-tert-butyl-4-hydroxyphenyl-substituted fatty acid esters. A mixture of two or more of these anti-oxidants may be used.

Examples of ashless dispersants include those exemplified with respect to Component (B). These ashless dispersants are preferably used so as to further improve the sludge dispersibility, high temperature detergency, and oxidation stability of the resulting lubricating oil composition.

Examples of metallic detergents include alkali metal or alkaline earth metal sulfonates, alkali metal or alkaline earth metal salicylates, alkali metal or alkaline earth metal phenates, and alkali metal or alkaline earth metal phosphonates. Known normal, basic, or overbased metallic detergents with a base number of 0 to 500 mgKOH/g may be used in the present invention. Examples of alkali metals referred herein include sodium and potassium. Examples of alkaline earth metals referred herein include calcium and magnesium. Calcium and magnesium are preferably used, and calcium is particularly preferably used. Although no particular limitation is imposed on the metal ratio of these metallic detergents, it is usually from 1 to 20 percent by mass. However, in order to further enhance the base number retaining properties at high temperature and in the presence of NOx and high temperature detergency, of the resulting lubricating oil composition, the metallic detergents are preferably alkali metal or alkaline earth metal salicylates whose metal ratio is adjusted to 2.3 or less or mixtures of alkali metal or alkaline earth metal salicylates whose metal ratio is 1.5 or less and alkali metal or alkaline earth metal sulfonates whose metal ratio is from 1 to 20. The term "metal ratio" used herein is represented by "valence of metal element×metal element content (mol %)/soap group content (mol %) in a metallic detergent" wherein the metal element is calcium, magnesium, or the like and the soap group is a sulfonic acid group, a salicylic acid group, or the like.

Examples of friction modifiers include molybdenum dithiocarbamates, molybdenum dithiophosphates, molybdenum disulfide, long-chain aliphatic amines, long-chain fatty acids, long-chain fatty acid esters, long-chain fatty acid amides, and long-chain aliphatic alcohols.

Examples of anti-wear agents other than Component (A) include phosphoric acid, phosphoric acid monoesters, phosphoric acid diesters, phosphoric acid triesters, phosphorus acid, phosphorus acid monoesters, phosphorus acid diesters, phosphorus acid triesters, amine salts thereof, zinc dithiophosphate, zinc dithiocarbamate, disulfides, olefin sulfides, and sulfurized fats and oils. Preferred anti-wear agents are those containing no sulfur.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal passivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile. Thiazoles and thiaziazoles may be used as an additive having anti-wear properties in the composition of the present invention.

Examples of anti-foaming agents include silicone, fluorosilicone, and fluoroalkyl ethers.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or the hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount.

When these additives are added to the lubricating oil composition of the present invention (inclusive the case where these additives are added in the form of an additive package), the content of each of the anti-oxidant, anti-wear agent other than Component (A) friction modifier, corrosion inhibitor, rust inhibitor, and demulsifier is selected from 0.005 to 5 percent by mass based on the total mass of the composition. The content of each of the ashless dispersant and metallic detergent is selected from 0.1 to 10 percent by mass. The content of the metal passivator is also selected from 0.005 to 1 percent by mass. The content of the anti-foaming agent is selected from 0.0005 to 1 percent by mass, while the content of the viscosity index improver is selected from 0.1 to 20 percent by mass.

In the present invention, a lubricating oil composition containing 0.3 percent by mass or less, preferably 0.1 percent by mass or less, and more preferably 0.01 percent by mass or less of sulfur or containing substantially no sulfur can be obtained by decreasing the amount of a sulfur-containing additive or not using such an additive.

The lubricating oil additives and lubricating oil compositions of the present invention are preferably used as those for internal combustion engines such as gasoline-, diesel-, and gas-engines of two- or four-wheel vehicles, generators, ships, or the like. The lubricating oil additives and lubricating oil compositions are particularly preferably used as those for internal combustion engines, particularly for gas engines using low-sulfur content fuels such as gasolines, gas oils, or kerosene each of whose sulfur content is 50 ppm by mass or less, preferably 30 ppm by mass or less, and particularly preferably 10 ppm by mass or less or fuels whose sulfur content is 1 ppm by mass or less (LPG, natural gas, hydrogen containing substantially no sulfur, dimethylether, alcohol, GTL, or the like). Furthermore, the lubricating oil additives of the present invention can improve the long drain properties of a lubricating oil composition while maintaining the anti-wear properties thereof and thus are suitably used as those for lubricating oils required to possess such properties, such as lubricating oils for driving systems such as automatic or manual transmissions, those for wet brakes, hydraulic oils, turbine oils, compressor oils, bearing oils, refrigerating oils, or the like.

BEST MODE FOR CARRYING OUT THE INVENTION

Hereinafter, the present invention will be described in more details by way of the following examples and comparative examples, which should not be construed as limiting the scope of the invention.

EXAMPLES 1 TO 13

In accordance with the formulations given below, lubricating oil additives A to M (Example 1 to 13) were prepared.

(1) Preparation of Metal Salts of Phosphorus Compounds (a) 0.196 mol of zinc oxide and 0.4 mol of dibutylphosphate were mixed in 200 ml of hexane and 40 ml of water and stirred at a temperature of 80° C. for 4 hours. The water phase of the resulting mixture was removed. After the hexane layer was filtered, the hexane of the filtrate was vacuum-distilled thereby obtaining zinc dibutylphosphate (a white solid, phosphorus content: 13.2 percent by mass, zinc content: 13 percent by mass). It was assumed that the resulting compound contained a compound with the following structure as the main component:

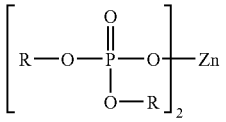

(b) The same procedure of (a) above was repeated except for using a mixture of mono/di(1,3-dimethyl)butylphosphates instead of dibutylphosphate thereby obtaining a mixture of zinc mono/di(1,3-dimethyl)butylphosphates (white solid, phosphorus content: 13.8 percent by mass, zinc content: 18.7 percent by mass). It was assumed that the resulting compound contained a mixture of compounds having the following structures as the main components:

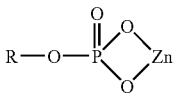

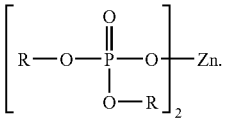

(c) The same procedure of (a) above was repeated except for using calcium hydroxide instead of zinc oxide and using di(2-ethylhexyl)phosphate instead of dibutylphosphate thereby obtaining calcium di(2-ethylhexyl) phosphate (white solid, phosphorus content: 9.1 percent by mass, calcium content: 5.8 percent by mass).

(d) The same procedure of (a) above was repeated except for using di(2-ethylhexyl)phosphate instead of dibutylphosphate thereby obtaining zinc di(2-ethylhexyl) phosphate (white solid, phosphorus content: 8.8 percent by mass, zinc content: 9.1 percent by mass).

Furthermore, the same procedure of the foregoing was conducted using various materials thereby obtaining the following compounds with a neutralization rate of 95 to 98 percent. All the compounds were solid at ordinary temperature.

(e) a mixture of zinc mono/di(n-butyl)phosphates,
(f) a mixture of zinc mono/di(2-ethylhexyl)phosphates,
(g) a mixture of zinc mono/di(n-octyl)phosphates,
(h) a mixture of zinc mono/di(isodecyl)phosphates,
(i) a mixture of zinc mono/di(n-dodecyl)phosphates,
(j) a mixture of zinc mono/di(isotridecyl)phosphates,
(k) a mixture of zinc mono/di(oleyl)phosphates,
(l) a mixture of zinc mono/di(stearyl)phosphates,
(m) a mixture of calcium mono/di(2-ethylhexyl)phosphates,
(n) magnesium di(2-ethylhexyl)phosphate
(o) a mixture of magnesium mono/di(2-ethylhexyl)phosphates,
(p) lithium di(2-ethylhexyl)phosphate,
(q) zinc salt of mono(2-ethylhexyl)$_2$-ethylhexylphosphonate (2) Preparation of Mixed Additives A to D of Metal Salts of Phosphorus Compounds and an Amine-Based Anti-Oxidant (Examples 1 to 4)

(A) After 500 g of the white solid obtained in (a) of (1) were dissolved in 1 kg of hexane, 500 g of an alkyldiphenylamine (alkyl group: butyl and octyl) were added thereto and mixed and stirred at a temperature of 40° C. for 30 minutes. The hexane was vacuum-distilled thereby obtaining a viscous additive A having fluidity at ordinary temperature (phosphorus content: 6.6 percent by mass).

(B) The same procedure of (A) above was repeated except for using the white solid obtained in (b) of (1) thereby obtaining a viscous additive B having fluidity at ordinary temperature (phosphorus content: 6.9 percent by mass).

(C) The same procedure of (A) above was repeated except for using the white solid obtained in (c) of (1) thereby obtaining a viscous additive C having fluidity at ordinary temperature (phosphorus content: 4.55 percent by mass).

(D) The same procedure of (A) above was repeated except for using the white solid obtained in (d) of (1) thereby obtaining a viscous additive D having fluidity at ordinary temperature (phosphorus content: 4.4 percent by mass).

(3) Preparation of Mixed Additives E to H of a Metal Salt of a Phosphorus Compound and an Ashless Dispersant (Examples 5 to 8)

(E) After 200 g of the white solid obtained in (a) of (1) were dissolved in 1 kg of hexane, 800 g of a commercially available polybutenylsuccinimide-based ashless dispersant SB (molecular weight of polybutenyl group: 1300, nitrogen content: 1.3 percent by mass, boron content: 0.5 percent by mass, base number (hydrochloric acid method): 24 mgKOH/g) were added to the solution and heated and stirred at a temperature of 40° C. for 30 minutes. The hexane was vacuum-distilled thereby obtaining a viscous additive E having fluidity at ordinary temperature (phosphorus content: 2.64 percent by mass).

(F) The same procedure of (E) above was repeated except for using the white solid obtained in (b) of (1) thereby obtaining a viscous additive F having fluidity at ordinary temperature (phosphorus content: 2.76 percent by mass).

(G) The same procedure of (E) above was repeated except for using the white solid obtained in (c) of (1) thereby obtaining a viscous additive G having fluidity at ordinary temperature (phosphorus content: 1.82 percent by mass).

(H) The same procedure of (E) above was repeated except for using the white solid obtained in (d) of (1) thereby obtaining a viscous additive H having fluidity at ordinary temperature (phosphorus content: 1.76 percent by mass).

The same procedure of the foregoing was repeated using the metal salts of phosphorus compounds (e) to (q) and a commercially available polybutenylsuccinimide-based ashless dispersant SB thereby obtaining viscous additives ($e_{SB}$ to $q_{SB}$) having fluidity at ordinary temperature.

(4) Preparation of Mixed Additives I to M of Amine-Based Anti-Oxidants and Ashless Dispersants (Examples 9 to 13)

(I) 400 g of the additive A obtained in (A) of (2) were added to 600 g of a commercially available polybutenylsuccinimide-based ashless dispersant SB and heated and stirred at a temperature of 80° C. for 1 hour thereby obtaining an additive I having fluidity at ordinary temperature (phosphorus content: 2.64 percent by mass).

(J) 400 g of the additive B obtained in (B) of (2) were added to 600 g of a commercially available polybutenylsuccinimide-based ashless dispersant SB and heated and stirred at a temperature of 80° C. for 1 hour thereby obtaining an additive J having fluidity at ordinary temperature (phosphorus content: 2.76 percent by mass).

(K) 400 g of the additive C obtained in (C) of (2) were added to 600 g of a commercially available polybutenylsuccinimide-based ashless dispersant SB and heated and stirred at a temperature of 80° C. for 1 hour thereby obtaining an additive K having fluidity at ordinary temperature (phosphorus content: 1.82 percent by mass).

(L) 400 g of the additive D obtained in (D) of (2) were added to 600 g of a commercially available polybutenylsuccinimide-based ashless dispersant SB and heated and stirred at a temperature of 80° C. for 1 hour thereby obtaining an additive L having fluidity at ordinary temperature (phosphorus content: 1.76 percent by mass).

(M) 100 g of the additive A obtained in (A) of (2), 400 g of a commercially available polybutenylsuccinimide-based ashless dispersant SB, 400 g of a calciumsalicylate-based detergent (calcium content: 6.2 percent by mass, metal ratio: 2.7), and 100 g of octyl-3-(3,5-di-tert-butyl-4-hydroxyphenyl) propionate were mixed and heated and stirred at a temperature of 80° C. for 1 hour thereby obtaining an additive M having fluidity at ordinary temperature (phosphorus content: 0.66 percent by mass, calcium content: 2.5 percent by mass).

(5) Preparation of Mixed Additives N to U of a Metal Salt of a Phosphorus Compound and an Aliphatic Amine Compound or a Mixture of an Aliphatic Amine Compound and an Amine-Based Anti-Oxidant (Examples 14 to 21)

(N) After 50 g of the zinc dibutylphosphate obtained in (a) of (1) were dissolved in 100 g of hexane, 50 g of oleylamine were added thereto and mixed and stirred at a temperature of 40° C. for 30 minutes. The hexane was vacuum-distilled thereby obtaining an additive N which was liquid and transparent at ordinary temperature (phosphorus content: 6.6 percent by mass)

(O) The same procedure of (N) was repeated except for using dodecylamine instead of oleylamine thereby obtaining an additive 0 which was liquid and transparent at ordinary temperature (phosphorus content: 6.6 percent by mass).

(P) The same procedure of (N) was repeated except for using dodecyldimethylamine instead of oleylamine thereby obtaining an additive P which was liquid and transparent at ordinary temperature (phosphorus content: 6.6 percent by mass).

(Q) The same procedure of (N) was repeated except for using a mixture of 10 g of oleylamine and 40 g of alkyldiphenylamine (alkyl group: butyl and octyl) instead of oleylamine thereby obtaining an additive Q which was liquid and transparent at ordinary temperature (phosphorus content: 6.6 percent by mass)

(R) The same procedure of (N) was repeated except for using a mixture of 10 g of dodecylamine and 40 g of alkyldiphenylamine (alkyl group: butyl and octyl) instead of oleylamine thereby obtaining an additive R which was liquid and transparent at ordinary temperature (phosphorus content: 6.6 percent by mass).

(S) The same procedure of (N) was repeated except for using 50 g of zinc mono/di(1,3-dimethylbutyl)phosphates obtained in (b) of (1) thereby obtaining an additive S which was liquid and transparent at ordinary temperature (phosphorus content: 6.9 percent by mass).

(T) The same procedure of (N) was repeated except for using 50 g of zinc di(2-ethylhexyl)phosphate obtained in (d) of (1), 25 g of dodecyldimethylamine, and 25 g of alkyldiphenylamine (alkyl group: butyl and octyl) thereby obtaining an additive T which was liquid and transparent at ordinary temperature (phosphorus content: 4.4 percent by mass).

(U) The same procedure of (N) was repeated except for using 50 g of magnesium di(2-ethylhexyl)phosphate of (n) in (1) thereby obtaining an additive U which was liquid and transparent at ordinary temperature.

The resulting lubricating oil additives A to U (Examples 1 to 21) were evaluated by a storage stability test, but neither precipitation nor cloud was observed.

EXAMPLES 22 TO 57 AND COMPARATIVE EXAMPLES 1 TO 12)

Lubricating oil compositions of the present invention (Examples 22 to 57) were prepared using lubricating oil additives A to M (Examples 1 to 13) in accordance with the formulations shown in Tables 1 to 3 below. Upon preparation, the dissolubility of each additive was evaluated by a dissolubility test. The dissolubility test was conducted by visually observing the dissolved state (whether insolubles were present or not) of the additive contained in each composition every predetermined time after sampling the composition in a mixing vessel at ordinary temperature and mixing the sample with heating and stirring at a temperature of 80° C.

For comparison, lubricating oil composition (Comparative Examples 1 to 12) were prepared in a conventional manner in accordance with the formulations shown in Table 4 below. The compositions were evaluated by the same dissolubility test in the same manner. The results are shown in Tables 1 to 4.

TABLE 1

| | | Examples | | | | | | | | | | | |
|---|---|---|---|---|---|---|---|---|---|---|---|---|---|
| | | 22 | 23 | 24 | 25 | 26 | 27 | 28 | 29 | 30 | 31 | 32 | 33 |
| Solvent-refined mineral oil[1)] | mass % | balance | balance | balance | balance | — | — | — | — | — | — | — | — |
| Hydrogenated mineral oil[2)] | mass % | — | — | — | — | balance | balance | balance | balance | — | — | — | — |
| Synthetic oil[3)] | mass % | — | — | — | — | — | — | — | — | balance | balance | balance | balance |
| Additive A[4)] | mass % | 1.06 | — | — | — | 1.06 | — | — | — | 1.06 | — | — | — |
| in terms of phosphorus | mass % | (0.07) | — | — | — | (0.07) | — | — | — | (0.07) | — | — | — |
| Additive B[5)] | mass % | — | 1.01 | — | — | — | 1.01 | — | — | — | 1.01 | — | — |
| in terms of phosphorus | mass % | — | (0.07) | — | — | — | (0.07) | — | — | — | (0.07) | — | — |
| Additive C[6)] | mass % | — | — | 1.53 | — | — | — | 1.53 | — | — | — | 1.53 | — |
| in terms of phosphorus | mass % | — | — | (0.07) | — | — | — | (0.07) | — | — | — | (0.07) | — |
| Additive D[7)] | mass % | — | — | — | 1.59 | — | — | — | 1.59 | — | — | — | 1.59 |
| in terms of phosphorus | mass % | — | — | — | (0.07) | — | — | — | (0.07) | — | — | — | (0.07) |
| Ashless dispersant[8)] | mass % | 4 | 4 | 4 | 4 | 4 | 4 | 4 | 4 | 4 | 4 | 4 | 4 |
| Ca salicylate[9)] | mass % | 11.3 | 2 | — | 11.3 | 2 | — | 11.3 | 2 | — | 11.3 | 2 | — |
| in terms of alkaline earth metal | mass % | (0.26) | (0.04) | — | (0.26) | (0.04) | — | (0.26) | (0.04) | — | (0.26) | (0.04) | — |
| Ca sulfonate[10)] | mass % | — | 2 | 2.2 | — | 2 | 2.2 | — | 2 | 2.2 | — | 2 | 2.2 |
| in terms of alkaline earth metal | mass % | — | (0.04) | (0.26) | — | (0.24) | (0.26) | — | (0.24) | (0.26) | — | (0.24) | (0.26) |
| Viscosity index improver[11)] | mass % | 4 | 4 | 4 | 4 | 4 | 4 | 4 | 4 | 4 | 4 | 4 | 4 |
| Demulsifier[12)] | mass % | 0.01 | 0.01 | 0.01 | 0.01 | 0.01 | 0.01 | 0.01 | 0.01 | 0.01 | 0.01 | 0.01 | 0.01 |
| Dissolubility test insolubles | after 2 hours | present | present | present | present | present | present | present | present | present | present | present | present |
| | after 4 hours | present | present | present | present | present | present | present | present | present | present | present | present |
| | after 8 hours | present | present | present | present | present | present | present | present | present | present | present | present |
| | after 16 hours | not-present | not-present | not-present | not-present | not-present | not-present | not-present | not-present | not-present | not-present | not-present | not-present |

[1)]Total aromatic content: 5.5 mass %, sulfur content: 1,300 mass ppm, 100° C. kinematic viscosity: 5.45 $mm^2/s$, viscosity index: 125

[2)]Total aromatic content: 1.2 mass %, sulfur content: 10 mass ppm, 100° C. kinematic viscosity: 5.6 $mm^2/s$, viscosity index: 125

[3)]Triester of neopentyl glycol 100° C. kinematic viscosity: 4.3 $mm^2/s$, viscosity index: 143

[4)]Additive A prepared in Preparation Example A (Phosphorus content: 6.6 mass %)

[5)]Additive B prepared in Preparation Example B (Phosphorus content: 6.9 mass %)

[6)]Additive C prepared in Preparation Example C (Phosphorus content: 4.55 mass %)

[7)]Additive D prepared in Preparation Example D (Phosphorus content: 4.4 mass %)

[8)]Polybutenyl succinimide, number average molecular weight of polybutenyl group: 1,300, nitrogen content: 1.6 mass %, boron content: 0 mass %

[9)]Ca content: 2.3 mass %, metal ratio: 1

[10)]Ca content: 12 mass %, metal ratio: 10

[11)]OCP average molecular weight: 150,000

[12)]Polyalkylene glycol-based

TABLE 2

| | | Examples | | | | | | | | | | | |
|---|---|---|---|---|---|---|---|---|---|---|---|---|---|
| | | 34 | 35 | 36 | 37 | 38 | 39 | 40 | 41 | 42 | 43 | 44 | 45 |
| Solvent-refined mineral oil[1)] | mass % | balance | balance | balance | balance | — | — | — | — | — | — | — | — |
| Hydrogenated mineral oil[2)] | mass % | — | — | — | — | balance | balance | balance | balance | — | — | — | — |
| Synthetic oil[3)] | mass % | — | — | — | — | — | — | — | — | balance | balance | balance | balance |
| Additive E[4)] | mass % | 2.7 | — | — | — | 2.7 | — | — | — | 2.7 | — | — | — |
| in terms of phosphorus | mass % | (0.07) | — | — | — | (0.07) | — | — | — | (0.07) | — | — | — |
| Additive F[5)] | mass % | — | 2.5 | — | — | — | 2.5 | — | — | — | 2.5 | — | — |
| in terms of phosphorus | mass % | — | (0.07) | — | — | — | (0.07) | — | — | — | (0.07) | — | — |
| Additive G[6)] | mass % | — | — | 3.8 | — | — | — | 3.8 | — | — | — | 3.8 | — |
| in terms of phosphorus | mass % | — | — | (0.07) | — | — | — | (0.07) | — | — | — | (0.07) | — |
| Additive H[7)] | mass % | — | — | — | 4 | — | — | — | 4 | — | — | — | 4 |
| in terms of phosphorus | mass % | — | — | — | (0.07) | — | — | — | (0.07) | — | — | — | (0.07) |
| Ashless dispersant[8)] | mass % | 1.3 | 1.5 | 0.2 | — | 1.3 | 1.5 | 0.2 | — | 1.3 | 1.5 | 0.2 | — |
| Ca salicylate[9)] | mass % | 6.3 | — | — | 6.3 | — | — | 6.3 | — | — | 6.3 | — | — |
| in terms of alkaline earth metal | mass % | (0.26) | — | — | (0.26) | — | — | (0.26) | — | — | (0.26) | — | — |
| Ca salicylate[10)] | mass % | — | 5.9 | — | — | 5.9 | — | — | 5.9 | — | — | 5.9 | — |
| in terms of alkaline earth metal | mass % | — | (0.28) | — | — | (0.28) | — | — | (0.28) | — | — | (0.28) | — |

TABLE 2-continued

| | | Examples | | | | | | | | | | | |
|---|---|---|---|---|---|---|---|---|---|---|---|---|---|
| | | 34 | 35 | 36 | 37 | 38 | 39 | 40 | 41 | 42 | 43 | 44 | 45 |
| Ca salicylate[11)] | mass % | — | — | 2.85 | — | — | 2.85 | — | — | 2.85 | — | — | 2.85 |
| in terms of alkaline earth metal | mass % | — | — | (0.26) | — | — | (0.26) | — | — | (0.26) | — | — | (0.26) |
| Anti-oxidant[12)] | mass % | 1 | 1 | 1 | 1 | 1 | 1 | 1 | 1 | 1 | 1 | 1 | 1 |
| Viscosity index improver[13)] | mass % | 4 | 4 | 4 | 4 | 4 | 4 | 4 | 4 | 4 | 4 | 4 | 4 |
| Demulsifier[14)] | mass % | 0.01 | 0.01 | 0.01 | 0.01 | 0.01 | 0.01 | 0.01 | 0.01 | 0.01 | 0.01 | 0.01 | 0.01 |
| Dissolubility test insolubles | after 2 hours | not-present | not-present | not-present | not-present | not-present | not-present | not-present | not-present | not-present | not-present | not-present | not-present |
| | after 4 hours | not-present | not-present | not-present | not-present | not-present | not-present | not-present | not-present | not-present | not-present | not-present | not-present |
| | after 8 hours | not-present | not-present | not-present | not-present | not-present | not-present | not-present | not-present | not-present | not-present | not-present | not-present |
| | after 16 hours | not-present | not-present | not-present | not-present | not-present | not-present | not-present | not-present | not-present | not-present | not-present | not-present |

1)Total aromatic content: 5.5 mass %, sulfur content: 1,300 mass ppm, 100° C. kinematic viscosity: 5.45 $mm^2/s$, viscosity index: 125

2)Total aromatic content: 1.2 mass %, sulfur content: 10 mass ppm, 100° C. kinematic viscosity: 5.6 $mm^2/s$, viscosity index: 125

3)Triester of neopentyl glycol 100° C. kinematic viscosity: 4.3 $mm^2/s$, viscosity index: 143

4)Additive E prepared in Preparation Example E (Phosphorus content: 2.64 mass %)

5)Additive F prepared in Preparation Example F (Phosphorus content: 2.76 mass %)

6)Additive G prepared in Preparation Example G (Phosphorus content: 1.82 mass %)

7)Additive H prepared in Preparation Example H (Phosphorus content: 1.76 mass %)

8)Polybutenyl succinimide, number average molecular weight of polybutenyl group: 1,300, nitrogen content: 1.6 mass %, boron content: 0 mass %

9)Ca content: 4.15 mass %, metal ratio: 1.8

10)Ca content 4.8 mass %, metal ratio: 2.1

11)Ca content: 8.12 mass %, metal ratio: 4.3

12)Alkyldiphenylamine (alkyl group: butyl, octyl)

13)OCP average molecular weight: 150,000

14)Polyalkylene glycol-based

TABLE 3

| | | Examples | | | | | | | | | | | |
|---|---|---|---|---|---|---|---|---|---|---|---|---|---|
| | | 46 | 47 | 48 | 49 | 50 | 51 | 52 | 53 | 54 | 55 | 56 | 57 |
| Solvent-refined mineral oil[1)] | mass % | balance | balance | balance | balance | — | — | — | — | — | — | — | — |
| Hydrogenated mineral oil[2)] | mass % | — | — | — | — | balance | balance | balance | balance | — | — | — | — |
| Synthetic oil[3)] | mass % | — | — | — | — | — | — | — | — | balance | balance | balance | balance |
| Additive I[4)] | mass % | — | — | — | — | 2.7 | — | — | — | 2.7 | — | — | — |
| in terms of phosphorus | mass % | — | — | — | — | (0.07) | — | — | — | (0.07) | — | — | — |
| Additive J[5)] | mass % | — | 2.5 | — | — | — | — | — | — | — | 2.5 | — | — |
| in terms of phosphorus | mass % | — | (0.07) | — | — | — | — | — | — | — | (0.07) | — | — |
| Additive K[6)] | mass % | — | — | 3.8 | — | — | — | 3.8 | — | — | — | — | — |
| in terms of phosphorus | mass % | — | — | (0.07) | — | — | — | (0.07) | — | — | — | — | — |
| Additive L[7)] | mass % | — | — | — | 4 | — | — | — | 4 | — | — | — | 4 |
| in terms of phosphorus | mass % | — | — | — | (0.07) | — | — | — | (0.07) | — | — | — | (0.07) |
| Additive M[8)] | mass % | 10 | — | — | — | — | 10 | — | — | — | — | 10 | — |
| in terms of phosphorus | mass % | (0.07) | — | — | — | — | (0.07) | — | — | — | — | (0.07) | — |
| in terms of alkaline earth metal | mass % | (0.25) | — | — | — | — | (0.25) | — | — | — | — | (0.25) | — |
| Ashless dispersant[9)] | mass % | — | 2 | 1 | 1 | 2 | — | 1 | 1 | 2 | 2 | — | 1 |
| Ca salicylate[10)] | mass % | — | 4 | 4 | 4 | 4 | — | 4 | 4 | 4 | 4 | — | 4 |
| in terms of alkaline earth metal | mass % | — | (0.25) | (0.25) | (0.25) | (0.25) | — | (0.25) | (0.25) | (0.25) | (0.25) | — | (0.25) |
| Anti-oxidant[11)] | mass % | — | 0.5 | 0.5 | 0.5 | 0.5 | — | 0.5 | 0.5 | 0.5 | 0.5 | — | 0.5 |
| Viscosity index improver[12)] | mass % | 4 | 4 | 4 | 4 | 4 | 4 | 4 | 4 | 4 | 4 | 4 | 4 |
| Demulsifier[13)] | mass % | 0.01 | 0.01 | 0.01 | 0.01 | 0.01 | 0.01 | 0.01 | 0.01 | 0.01 | 0.01 | 0.01 | 0.01 |

TABLE 3-continued

| | | Examples | | | | | | | | | | | |
|---|---|---|---|---|---|---|---|---|---|---|---|---|---|
| | | 46 | 47 | 48 | 49 | 50 | 51 | 52 | 53 | 54 | 55 | 56 | 57 |
| Dissolubility test insolubles | after 2 hours | not-present | not-present | not-present | not-present | not-present | not-present | not-present | not-present | not-present | not-present | not-present | not-present |
| | after 4 hours | not-present | not-present | not-present | not-present | not-present | not-present | not-present | not-present | not-present | not-present | not-present | not-present |
| | after 8 hours | not-present | not-present | not-present | not-present | not-present | not-present | not-present | not-present | not-present | not-present | not-present | not-present |
| | after 16 hours | not-present | not-present | not-present | not-present | not-present | not-present | not-present | not-present | not-present | not-present | not-present | not-present |

1)Total aromatic content: 5.5 mass %, sulfur content: 1,300 mass ppm, 100° C. kinematic viscosity: 5.45 $mm^2/s$, viscosity index: 125
2)Total aromatic content: 1.2 mass %, sulfur content: 10 mass ppm, 100° C. kinematic viscosity: 5.6 $mm^2/s$, viscosity index: 125
3)Triester of neopentyl glycol 100° C. kinematic viscosity: 4.3 $mm^2/s$, viscosity index: 143
4)Additive I prepared in Preparation Example I (Phosphorus content: 2.64 mass %)
5)Additive J prepared in Preparation Example J (Phosphorus content: 2.76 mass %)
6)Additive K prepared in Preparation Example K (Phosphorus content: 1.82 mass %)
7)Additive L prepared in Preparation Example L (Phosphorus content: 1.76 mass %)
8)Additive M prepared in Preparation Example M (Phosphorus content: 0.66 mass %, Ca content: 2.5 mass %)
9)Polybutenyl succinimide, number average molecular weight of polybutenyl group: 1,300, nitrogen content: 1.6 mass %, boron content: 0 mass %
10)Ca content: 6.2 mass %, metal ratio: 2.7
11)Octyl-3-(3,5-di-tert-nutyl-4-hydroxyphenyl)propionate
12)OCP average molecular weight: 150,000
13)Polyalkylene glycol-based

TABLE 4

| | | Comparative Examples | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Solvent-refined mineral oil1) | mass % | balance | balance | balance | balance | — | — | — | — | — | — | — | — |
| Hydrogenated mineral oil2) | mass % | — | — | — | — | balance | balance | balance | balance | — | — | — | — |
| Synthetic oil3) | mass % | — | — | — | — | — | — | — | — | balance | balance | balance | balance |
| (A) Zinc dialkylphosphate4) in terms of phosphorus | mass % | 0.5 | — | — | — | 0.5 | — | — | — | 0.5 | — | — | — |
| | mass % | (0.07) | — | — | — | (0.07) | — | — | — | (0.07) | — | — | — |
| (A) Zinc mono/dialkylphosphate5) in terms of phosphorus | mass % | — | 0.5 | — | — | — | 0.5 | — | — | — | 0.5 | — | — |
| | — mass % | (0.07) | — | — | — | (0.07) | — | — | — | (0.07) | — | — | |
| (A) Calcium dialkylphosphate6) in terms of phosphorus | mass % | — | — | 0.8 | — | — | — | 0.8 | — | — | — | 0.8 | — |
| | mass % | — | — | (0.07) | — | — | — | (0.07) | — | — | — | (0.07) | — |
| (A) Zinc dialkyl-monothiophosphate7) in terms of phosphorus | mass % | — | — | — | 0.8 | — | — | — | 0.8 | — | — | — | 0.8 |
| | mass % | — | — | — | (0.07) | — | — | — | (0.07) | — | — | — | (0.07) |
| Ashless dispersant8) | mass % | 4 | 4 | 4 | 4 | 4 | 4 | 4 | 4 | 4 | 4 | 4 | 4 |
| Ca salicylate9) in terms of alkaline earth metal | mass % | 4 | 4 | 4 | 4 | 4 | 4 | 4 | 4 | 4 | 4 | 4 | 4 |
| | mass % | (0.25) | (0.25) | (0.25) | (0.25) | (0.25) | (0.25) | (0.25) | (0.25) | (0.25) | (0.25) | (0.25) | (0.25) |
| (B) Amine-based anti-oxidant10) | mass % | 1 | 1 | 1 | 1 | 1 | 1 | 1 | 1 | 1 | 1 | 1 | 1 |
| Viscosity index improver11) | mass % | 4 | 4 | 4 | 4 | 4 | 4 | 4 | 4 | 4 | 4 | 4 | 4 |
| Demulsifier12) | mass % | 0.01 | 0.01 | 0.01 | 0.01 | 0.01 | 0.01 | 0.01 | 0.01 | 0.01 | 0.01 | 0.01 | 0.01 |
| Dissolubility test insolubles | after 2 hours | present | present | present | present | present | present | present | present | present | present | present | present |
| | after 4 hours | present | present | present | present | present | present | present | present | present | present | present | present |
| | after 8 hours | present | present | present | present | present | present | present | present | present | present | present | present |
| | after 16 hours | present | present | present | present | present | present | present | present | present | present | present | present |

1)Total aromatic content: 5.5 mass %, sulfur content: 1,300 mass ppm, 100° C. kinematic viscosity: 5.45 $mm^2/s$, viscosity index: 125
2)Total aromatic content: 1.2 mass %, sulfur content: 10 mass ppm, 100° C. kinematic viscosity: 5.6 $mm^2/s$, viscosity index: 125
3)Triester of neopentyl glycol 100° C. kinematic viscosity: 4.3 $mm^2/s$, viscosity index: 143
4)Alkyl group: butyl, phosphorus content: 13.2 mass %, zinc content: 13 mass %, sulfur content: 0 mass %
5)Alkyl group: 1,3 dimethylbutyl, phosphorus content: 13.8 mass %, zinc content: 18.7 mass %
6)Alkyl group: 2 ethylhexyl, phosphorus content: 9.1 mass %, calcium content: 5.8 mass %
7)Alkyl group: 2 ethylhexyl, phosphorus content: 8.8 mass %, zinc content: 9.1 mass %
8)Polybutenyl succinimide, number average molecular weight of polybutenyl group: 1,300, nitrogen content: 1.6 mass %, boron content: 0 mass %
9)Ca content: 6.2 mass %, metal ratio: 2.7
10)Alkyldiphenylamine (alkyl group: butyl, octyl)
11)OCP average molecular weight: 150,000
12)Polyalkylene glycol-based As apparent from the results shown in Tables 1 to 3, the insolubles of the lubricating oil compositions containing the lubricating oil additives of the present invention had disappeared after 16 hours because they were fully dissolved. Furthermore, as shown in Tables 2 and 3, the insolubles of the compositions each containing the additive of the present invention obtained using an ashless dispersant as Component (B) (Examples 34 to 57) had disappeared after 2 hours and been dissolved for a short period of time. It was also confirmed that any problem concerning storage stability did not arise with these lubricating oil compositions. It was also confirmed that even zinc dialkylmonothiophosphate (footnote 7 in Table 4) could be made oil-dissoluble in the same manner as that of the present invention thereby producing a lubricating oil composition for a short period of time.

Furthermore, the additives $e_{SB}$ to $q_{SB}$ obtained in (3) above and those N to U obtained in (5) above were dissolved in the lubricating base oils referred to as footnotes 1), 2), and 3) in Tables 1 to 3. As a result, the insolubles were fully dissolved and disappeared within 2 hours.

On the other hand, as shown in Table 4, in the case where a metal salt of a phosphorus compound was heated and stirred together with a lubricating base oil and other additives (Comparative Examples 1 to 12), insolubles were present even after the lapse of 16 hours and not dissolved completely. It takes another longer period of time to dissolve the insolubles completely.

Other lubricating oil additives of the present invention were obtained using polybutenylsuccinimide-based ashless dispersant SA not modified with boric acid (molecular weight of polybutenyl group: 1300, nitrogen content: 1.6 mass %, boron content: 0 mass %, base number (hydrochloric acid method): 24 mgKOH/g) instead of the commercially available polybutenylsuccinimide-based ashless dispersant SB used in Examples 5 to 13 (additives E to M of the present invention). Lubricating oil compositions containing such additives had similar results to those achieved by the present invention as described above.

It was confirmed that the lubricating oil composition of the present invention was equal in anti-wear properties to those using zinc dialkyldithiophosphates and could be significantly improved in long drain properties as defined by oxidation stability and base number retaining properties as well as high temperature detergency, low friction properties, copper-corrosion inhibiting properties, or the like and it was possible to produce a lubricating oil composition containing sulfur in an amount of 0.3 percent by mass or less, preferably 0.1 percent by mass or less, more preferably 0.01 percent by mass or less, and particularly preferably substantially no sulfur. It was also confirmed that the lubricating oil composition of the present invention could perform the above-described properties particularly in internal combustion engines using gasoline with a sulfur content of 10 ppm by mass or less or natural gas with a sulfur content of 1 ppm by mass or less.

APPLICABILITY IN THE INDUSTRY

The lubricating oil additive of the present invention enables a metal salt of a phosphorus compound contained on the additive which salt is insoluble or less soluble in a lubricating oil, to be fully dissolved therein for a short period of time. Particularly, when a lubricating oil composition is prepared using an additive obtained by dissolving or reacting a metal salt of a phosphorus compounds in or with an amine compound such as an ashless dispersant or an aliphatic amine beforehand, the composition can be produced for a short period of time, similarly to conventional lubricating oil composition. Therefore, the present invention can provide an lubricating oil additive which is significantly useful for industrially mass-producing a lubricating oil composition having the above-described excellent properties and a process for producing such an additive.

The invention claimed is:

1. A lubricating oil additive comprising at least one lubricating oil additive selected from the group consisting of (1) to (5) below:

(1) a lubricating oil additive obtained by dissolving Component (A) in Component (B) comprising an amine-based antioxidant;

(2) a lubricating oil additive obtained by reacting Component (A) with Component (B) comprising a succinimide and/or derivative thereof;

(3) a lubricating oil additive obtained by reacting Component (A) with Component (B) comprising an aliphatic amine having 8 to 30 carbon atoms;

(4) a lubricating oil additive obtained by reacting Component (A) with Component (B) comprising a mixture of an amine-based antioxidant and a succinimide and/or derivative thereof; and (5) a lubricating oil additive obtained by reacting Component (A) with Component (B) comprising a mixture of an amine-based antioxidant and an aliphatic amine;

wherein Component (A) comprises at least one compound selected from the group consisting of zinc salts of phosphorus compounds represented by formulas (2):

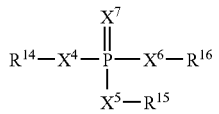

(2)

wherein $X^4$, $X^5$, $X^6$, and $X^7$ are each oxygen and $R^{14}$, $R^{15}$, and $R^{16}$ are each independently hydrogen or a hydrocarbon group having 1 to 30 carbon atoms provided that at least one of them is hydrogen.

2. The lubricating oil additive according to claim 1, wherein the succinimide and/or derivative thereof is a compound having a base number of 5 mgKOH/g or more determined by a hydrochloric acid method.

3. The lubricating oil additive according to claim 1, wherein the derivative of the succinimide is a boron compound derivative of the succinimide.

4. The lubricating oil additive according to claim 1, wherein the aliphatic amine is a tertiary amine.

5. A lubricating oil additive comprising the lubricating oil additive as defined in claim 1 and at least one selected from the group consisting of lubricating base oils, anti-oxidants, ashless dispersants, metallic detergents, friction modifiers, anti-wear agents, corrosion inhibitors, rust inhibitors, demulsifiers, metal passivators, anti-foaming agents, dyes, and viscosity index improvers.

6. A lubricating oil composition comprising a lubricating base oil and the lubricating oil additive as defined in claim 1.

7. A process for producing a lubricating oil additive comprising at least one process selected from the group consisting of processes (1) to (5) below:

(1) dissolving Component (A) in Component (B) comprising an amine-based antioxidant;

(2) reacting Component (A) with Component (B) comprising a succinimide and/or derivative thereof;

(3) reacting component (A) with Component (B) comprising an aliphatic amine;

(4) reacting Component (A) with Component (B) comprising a mixture of an amine-based antioxidant and a succinimide and/or derivative thereof; and (5) reacting Component (A) with Component (B) comprising a mixture of an amine-based antioxidant and an aliphatic amine having 8 to 30 carbon atoms;

wherein Component (A) comprises at least one compound selected from the group consisting of zinc salts of phosphorus compounds represented by formula (2):

(2)

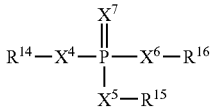

wherein $X^4$, $X^5$, $X^6$, and $X^7$ are each oxygen and $R^{14}$, $R^{15}$, and $R^{16}$ are each independently hydrogen or a hydrocarbon group having 1 to 30 carbon atoms provided that at least one of them is hydrogen.

8. A process for producing a lubricating oil composition comprising blending a lubricating base oil with the lubricating additive as defined in claim 1.

9. The process for producing a lubricating oil comprising according to claim 7, wherein a temperature at which compound (A) is dissolved in and reacted with component (B) is in a range of 30 to 90° C.

10. The lubricating oil additive according to claim 1, wherein the additive comprises at least one additive selected from the group consisting of (2) to (5).

11. The process for producing a lubricating oil additive according to claim 7, wherein the process comprises at least one process selected from (2) to (5).

12. The process for producing a lubricating oil additive according to claim 7, wherein a reaction ratio of Component (A) to the aliphatic amine or the succinimide and/or derivative thereof is 1 part by mass: 0.1 to 30 parts by mass.

13. The lubricating oil additive according to claim 1, wherein the aliphatic amine in additive (3) has 12 to 30 carbon atoms.

14. The process for producing a lubricating oil additive according to claim 7, wherein the aliphatic amine in process (3) has 12 to 30 carbon atoms.

* * * * *